US008079212B2

(12) United States Patent
Matsuoka et al.

(10) Patent No.: US 8,079,212 B2
(45) Date of Patent: Dec. 20, 2011

(54) EXHAUST PURIFYING APPARATUS AND EXHAUST PURIFYING METHOD FOR INTERNAL COMBUSTION ENGINE

(75) Inventors: Hiroki Matsuoka, Susono (JP); Yukihisa Yamamoto, Kariya (JP)

(73) Assignees: Toyota Jidosha Kabushiki Kaisha, Toyota-shi (JP); Kabushiki Kaisha Toyota Jidoshokki, Kariya-shi (JP)

( * ) Notice: Subject to any disclaimer, the term of this patent is extended or adjusted under 35 U.S.C. 154(b) by 617 days.

(21) Appl. No.: 10/589,205

(22) PCT Filed: Mar. 10, 2005

(86) PCT No.: PCT/JP2005/004736

§ 371 (c)(1),
(2), (4) Date: Aug. 11, 2006

(87) PCT Pub. No.: WO2005/088109

PCT Pub. Date: Sep. 22, 2005

(65) Prior Publication Data

US 2007/0163242 A1 Jul. 19, 2007

(30) Foreign Application Priority Data

Mar. 11, 2004 (JP) ..... 2004-068998

(51) Int. Cl.
*F01N 3/00* (2006.01)

(52) U.S. Cl. ..... 60/295; 60/274; 60/286; 60/303

(58) Field of Classification Search ..... 60/295, 60/297, 311, 274, 286, 303; 123/198 F, 481
See application file for complete search history.

(56) References Cited

U.S. PATENT DOCUMENTS

| | | | | |
|---|---|---|---|---|
| 4,615,172 | A * | 10/1986 | Mayer | 60/274 |
| 4,813,233 | A * | 3/1989 | Vergeer et al. | 60/286 |
| 4,974,414 | A | 12/1990 | Kono et al. | |
| 5,319,930 | A * | 6/1994 | Shinzawa et al. | 60/286 |
| 5,983,157 | A * | 11/1999 | Sugitani | 701/207 |
| 6,128,899 | A * | 10/2000 | Oono et al. | 60/295 |
| 6,199,372 | B1 * | 3/2001 | Wakamoto | 60/274 |
| 6,510,685 | B2 * | 1/2003 | Bolz et al. | 60/285 |
| 6,829,886 | B2 * | 12/2004 | Nakata | 60/277 |
| 6,901,750 | B2 * | 6/2005 | Toshioka et al. | 60/295 |
| 6,931,842 | B2 * | 8/2005 | Ohtake et al. | 60/295 |
| 7,017,337 | B2 * | 3/2006 | Plote et al. | 60/295 |
| 7,062,906 | B2 * | 6/2006 | Otake et al. | 60/295 |
| 7,146,804 | B2 * | 12/2006 | Yahata et al. | 60/295 |
| 7,380,396 | B2 * | 6/2008 | Kresse | 60/295 |
| 7,634,907 | B2 * | 12/2009 | Colignon | 60/286 |

(Continued)

FOREIGN PATENT DOCUMENTS

EP 1 234 959 A 8/2002

(Continued)

OTHER PUBLICATIONS

Korean Office Action, May 17, 2007.

*Primary Examiner* — Tu Nguyen
(74) *Attorney, Agent, or Firm* — Kenyon & Kenyon LLP

(57) ABSTRACT

In an exhaust purifying apparatus for an internal combustion engine on a vehicle, heating control is executed for supplying fuel to exhaust purification catalysts, thereby increasing the catalyst bed temperature. The heating control is suspended when the vehicle is determined to be driving downhill. Adverse influences due to deactivation of the exhaust purification catalysts during the heating control are reliably avoided.

6 Claims, 7 Drawing Sheets

U.S. PATENT DOCUMENTS

| | | | | |
|---|---|---|---|---|
| 2002/0112472 | A1 | 8/2002 | Tashiro et al. | |
| 2004/0035101 | A1 * | 2/2004 | Imai et al. | 60/295 |
| 2004/0055279 | A1 * | 3/2004 | Plote et al. | 60/274 |
| 2005/0166580 | A1 | 8/2005 | Pfaeffle et al. | |
| 2007/0130916 | A1 * | 6/2007 | Colignon | 60/286 |

FOREIGN PATENT DOCUMENTS

| | | | |
|---|---|---|---|
| EP | 1 388 647 | A2 | 2/2004 |
| JP | 05-044434 | | 2/1993 |
| JP | 2005-214203 | A | 8/2005 |
| KR | 1989-2524 | A | 4/1989 |

* cited by examiner

Fig. 8
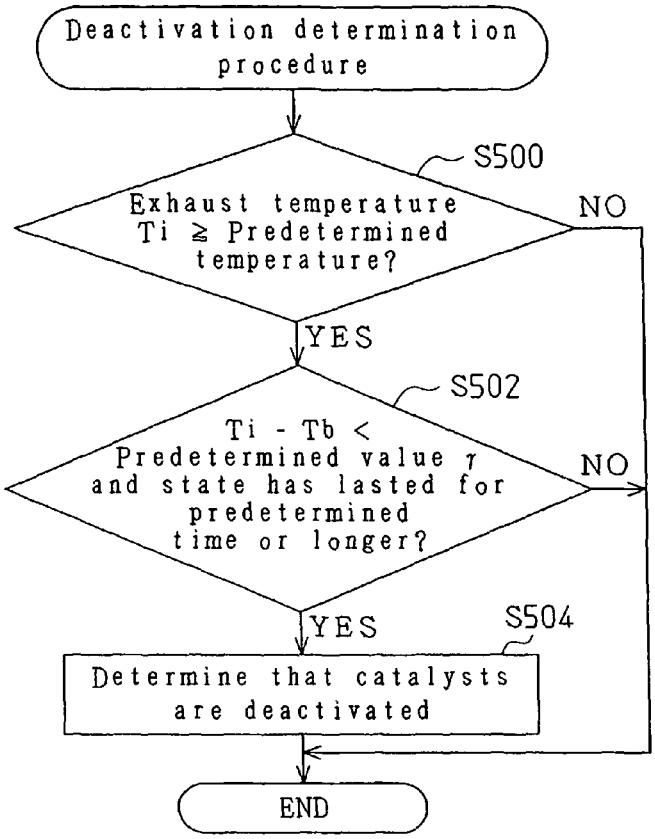
Fig. 9(a)
Downhill Flag
Fig. 9(b)
Elapsed Time of State of (Ti - Tb) <γ
Fig. 9(c)
Elapsed Time of ON State of Downhill Flag
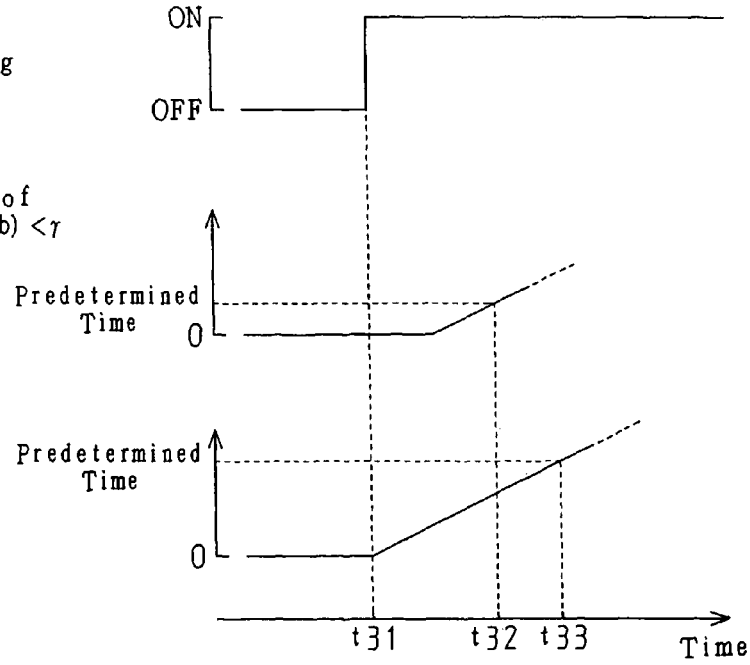

EXHAUST PURIFYING APPARATUS AND EXHAUST PURIFYING METHOD FOR INTERNAL COMBUSTION ENGINE

INCORPORATION BY REFERENCE

This is a 371 national phase application of PCT/JP2005/004736 filed 10 Mar. 2005, claiming priority to Japanese Patent Application No. 2004-068998 filed 11 Mar. 2004, the contents of which are incorporated herein by reference.

FIELD OF THE INVENTION

The present invention relates to an exhaust purifying apparatus and an exhaust purifying method for an internal combustion engine on a vehicle, which apparatus performs heating control for increasing the temperature of an exhaust purification catalyst by adding fuel to the catalyst.

BACKGROUND OF THE INVENTION

As disclosed in Japanese Laid-Open Patent Publication No. 5-44434, a typical exhaust purifying apparatus applied to an internal combustion engine on a vehicle includes an exhaust purification catalyst located in an exhaust system. The exhaust purification catalyst functions to trap particulate matter (PM) and nitrogen oxides (NOx) contained in exhaust gas.

Such an exhaust purifying apparatus estimates the amount of particulate matter accumulated in an exhaust purification catalyst based on the operation state of an engine. When the amount of the accumulated particulate matter is no less than a permissible value, the apparatus performs heating control to regenerate the catalyst, the performance of which has been degraded due to clogging of particulate matter. In the heating control, the apparatus supplies fuel to the exhaust purification catalyst to heat the catalyst, and uses the heat to burn and remove particulate matter accumulated in the exhaust purification catalyst.

Performing the heating control is known to cause the following problems. That is, depending on the operation state of the engine, the exhaust temperature is decreased, which deactivates the catalyst. This hampers oxidation of fuel supplied to the catalyst. Continuation of supply of fuel to the exhaust purification catalyst in a deactivated state causes a great amount of fuel to collect on the surface of the catalyst. This in turn increases the amount of accumulated particulate matter. Also, since some of the fuel supplied to the exhaust purification catalyst passes through the catalyst and is emitted, the properties of exhaust gas are degraded.

Not only for burning and removing particulate matter, the heating control is performed, for example, for regenerating a catalyst that has been poisoned with sulfur contained in exhaust gas. When the heating control is performed for releasing sulfur, if the catalyst is deactivated, the sulfur releasing cannot be completed, and thus, the above described problem is caused.

SUMMARY OF THE INVENTION

Accordingly, it is an objective of the present invention to provide an exhaust gas purifying apparatus and an exhaust purifying method, which eliminate problems due to deactivation of an exhaust purification catalyst during the heating control, for an internal combustion engine on a vehicle.

To achieve the foregoing and other objectives and in accordance with the purpose of the invention, an exhaust purifying apparatus for an internal combustion engine on a vehicle is provided. The apparatus has a regeneration control section. The regeneration control section controls regeneration of an exhaust purification catalyst through heating control, in which fuel is supplied to the exhaust purification catalyst, thereby increasing a bed temperature of the catalyst. The apparatus further includes a determining section that determining whether the vehicle is driving downhill. The regeneration control section suspends the heating control when the determining section determines that the vehicle is driving downhill.

The present invention also provides an exhaust purifying method for an internal combustion engine on a vehicle. The method includes: supplying fuel to an exhaust purification catalyst to increase a bed temperature of the catalyst, thereby regenerating the exhaust purification catalyst; determining whether the vehicle is driving downhill; and suspending the supply of fuel to the exhaust purification catalyst when the vehicle is determined to be driving downhill.

BRIEF DESCRIPTION OF THE DRAWINGS

FIG. 8 is a flowchart showing a process for determining deactivation according to the second embodiment; and FIG. 9 is a timing chart including sections (a) to (c), which show an example of the suspending process according to the second embodiment.

DETAILED DESCRIPTION OF THE PREFERRED EMBODIMENTS

Hereinafter, an exhaust purifying apparatus for an internal combustion engine 2 on a vehicle according to a first embodiment of the present invention will be described.

Figure 1:
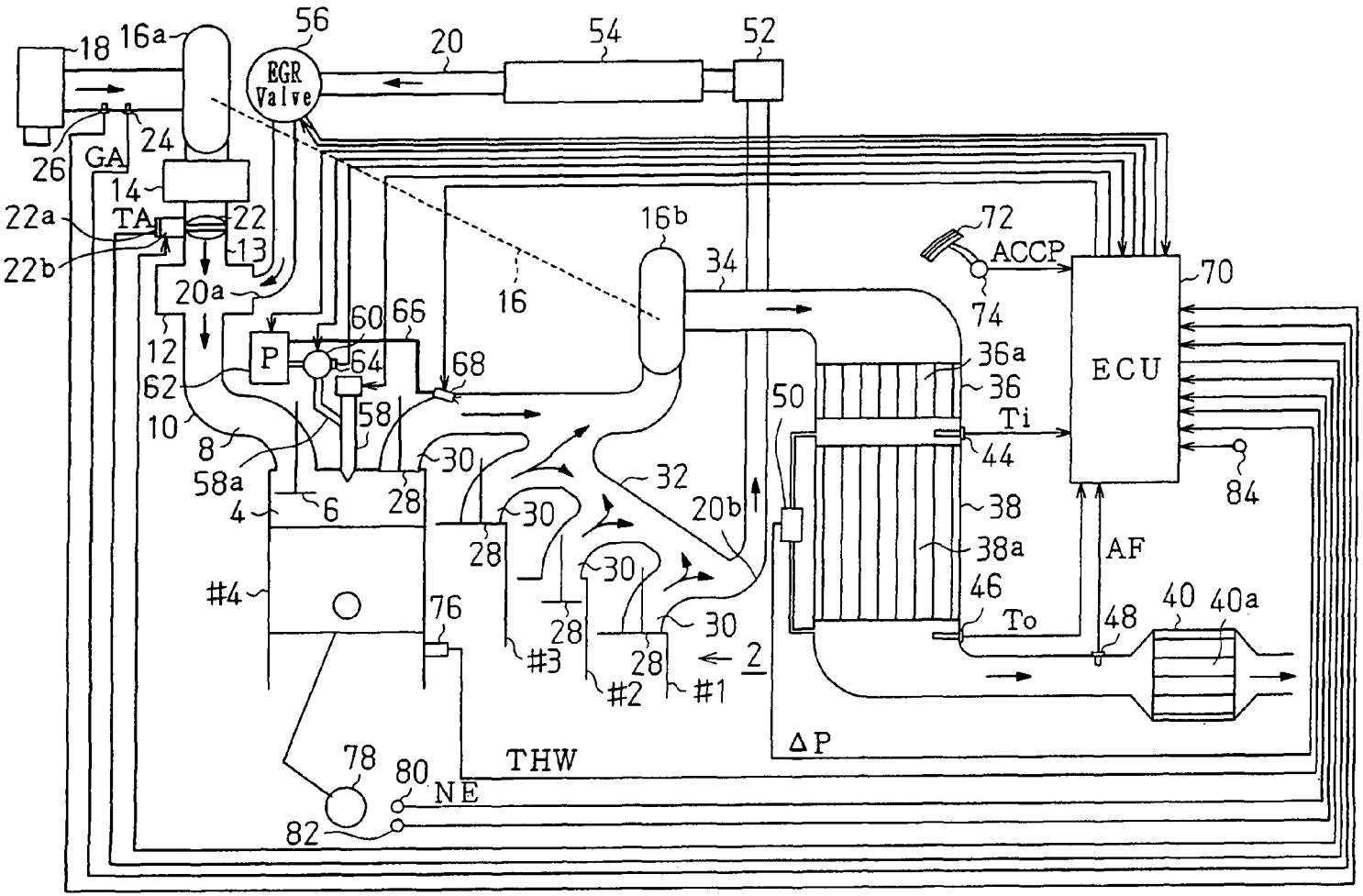
FIG. 1 is a block diagram illustrating an internal combustion engine on a vehicle to which a first embodiment of the present invention is applied.

FIG. 1 illustrates the configuration of the internal combustion engine 2 to which the exhaust purifying apparatus according to this embodiment is applied. The internal combustion engine 2 is mounted on a vehicle such as an automobile, and functions as a power source.

The engine 2 has cylinders. In this embodiment, the number of the cylinders is four, and the cylinders are denoted as #1, #2, #3, and #4. A combustion chamber 4 of each of the cylinders #1 to #4 includes an intake port 8, which is opened and closed by an intake valve 6. The combustion chambers 4 are connected to a surge tank 12 via the intake ports 8 and an intake manifold 10. The surge tank 12 is connected to an intercooler 14 and an outlet of a supercharger with an intake passage 13. In this embodiment, the supercharger is a compressor 16*a* of an exhaust turbocharger 16. An inlet of the compressor 16*a* is connected to an air cleaner 18. An exhaust gas recirculation (hereinafter, referred to as EGR) passage 20 is connected to the surge tank 12. Specifically, an EGR gas supply port 20*a* of the EGR passage 20 opens to the surge tank 12. A throttle valve 22 is located in a section of the intake passage 13 between the surge tank 12 and the intercooler 14. An intake flow rate sensor 24 and an intake temperature sensor 26 are located in a section between the compressor 16*a* and the air cleaner 18.

The combustion chamber 4 of each of the cylinders #1 to #4 includes an exhaust gas port 30, which is opened and closed by an exhaust gas valve 28. The combustion chambers 4 are connected to an inlet of an exhaust turbine 16*b* via the exhaust gas ports 30 and an exhaust manifold 32. An outlet of the exhaust turbine 16*b* is connected to an exhaust passage 34. The exhaust turbine 16*b* draws exhaust gas from a section of the exhaust manifold 32 that corresponds to the side of the fourth cylinder #4.

Three catalytic converters 36, 38, 40 each containing an exhaust purification catalyst are located in the exhaust passage 34. The first catalytic converter 36 located at the most upstream section contains a NOx storage reduction catalyst 36*a*. When exhaust gas is an oxidizing atmosphere (lean) during a normal operation of the engine 2, the NOx storage reduction catalyst 36*a* stores NOx. When the exhaust gas is a reducing atmosphere (stoichiometric or lower air-fuel ratio), NOx that has been stored in the NOx storage reduction catalyst 36*a* is released as NO and reduced with hydrocarbon and carbon oxide contained in exhaust gas. NOx is removed in this manner.

A second catalytic converter 38 containing a filter 38*a* is located at the second position from the most upstream side. The filter 38*a* has a monolithic wall. The wall has pores through which exhaust gas passes. The areas about the pores of the exhaust filter 38*a* are coated with a layer of a NOx storage reduction catalyst. Therefore, the NOx storage reduction catalyst functions as an exhaust purification catalyst to remove NOx as described above. Further, the filter wall traps particulate matter in exhaust gas. Thus, active oxygen, which is generated in a high-temperature oxidizing atmosphere when NOx is stored, starts oxidizing particulate matter. Further, ambient excessive oxygen oxidizes the entire particulate matter. Accordingly, particulate matter is removed at the same time as NOx is removed.

A third catalytic converter 40 is located in the most downstream section. The third catalytic converter 40 contains an oxidation catalyst 40*a*, which oxidizes and purifies hydrocarbon and carbon monoxide in exhaust gas to purify the exhaust gas.

A first exhaust temperature sensor 44 is located between the NOx storage reduction catalyst 36*a* and the filter 38*a*. A second exhaust temperature sensor 46 and an air-fuel ratio sensor 48 are located between the filter 38*a* and the oxidation catalyst 40*a*. The second exhaust temperature sensor 46 is closer to the filter 38*a* than the oxidation catalyst 40*a*. The air-fuel ratio sensor 48 is located closer to the oxidation catalyst 40*a* than the filter 38*a*. The air-fuel ratio sensor 48 includes a solid electrolyte and detects the air-fuel ratio of exhaust gas based on components of the exhaust gas. The air-fuel ratio sensor 48 outputs a voltage signal in proportion to the detected air-fuel ratio. The first exhaust temperature sensor 44 detects an exhaust temperature Ti at the corresponding position. Likewise, the second exhaust temperature sensor 46 detects an exhaust temperature To at the corresponding position.

Pipes of a differential pressure sensor 50 are connected to a section upstream of the filter 38*a* and a section downstream of the filter 38*a*. The differential pressure sensor 50 detects the pressure difference ΔP between the sections upstream and downstream of the filter 38*a*, thereby detecting the degree of clogging of the filter 38*a*. The degree of clogging represents the degree of accumulation of particulate matter in the filter 38*a*.

An EGR gas intake port 20*b* of the EGR passage 20 is provided in the exhaust manifold 32. The EGR gas intake port 20*b* is open at a section that corresponds to the side of the first cylinder #1, which is opposite to the side of the fourth cylinder #4, at which the exhaust turbine 16*b* introduces exhaust gas.

An EGR catalyst 52 is located in the EGR passage 20. The EGR catalyst 52 reforms EGR gas from the EGR gas intake port 20*b* of the EGR passage 20. Also, an EGR cooler 54 for cooling EGR gas is located in the EGR passage 20. The EGR catalyst 52 also functions to prevent clogging of the EGR cooler 54. An EGR valve 56 is located upstream of the EGR gas supply port 20*a*. The opening degree of the EGR valve 56 is changed to adjust the amount of EGR gas supplied from the EGR gas supply port 20*a* to the intake system.

Each of the cylinders #1 to #4 is provided with a fuel injection valve 58 that directly injects fuel into the corresponding combustion chamber 4. The fuel injection valves 58 are connected to a common rail 60 with fuel supply pipes 58*a*. A variable displacement fuel pump 62 supplies fuel to the common rail 60. High pressure fuel supplied from the fuel pump 62 to the common rail 60 is distributed to the fuel injection valves 58 through the fuel supply pipes 58*a*. A fuel pressure sensor 64 for detecting the pressure of fuel is attached to the common rail 60.

Further, the fuel pump 62 also supplies low pressure fuel to a fuel adding valve 68 through a fuel supply pipe 66. The fuel adding valve 68 is provided in the exhaust gas port 30 of the fourth cylinder #4 and injects fuel toward the exhaust turbine 16*b*. In this manner, the fuel adding valve 68 adds fuel to exhaust gas. A catalyst control mode, which is described below, is executed by such addition of fuel.

An electronic control unit (ECU) 70 is mainly composed of a digital computer having a CPU, a ROM, and a RAM, and drive circuits for driving other devices. In this embodiment, the ECU 70 functions as a regeneration control section and a determining section. As the regeneration control section, the ECU 70 controls regeneration of the exhaust purification catalysts. As the determining section, the ECU 70 determines whether the vehicle is driving downhill.

The ECU 70 reads signals from the intake flow rate sensor 24, the intake temperature sensor 26, the first exhaust temperature sensor 44, the second exhaust temperature sensor 46, the air-fuel ratio sensor 48, the differential pressure sensor 50, an EGR opening degree sensor in the EGR valve 56, the fuel pressure sensor 64, and a throttle opening degree sensor 22*a*. Further, the ECU 70 reads signals from an acceleration pedal sensor 74 that detects the depression degree of an acceleration pedal 72 (acceleration opening degree ACCP), and a coolant temperature sensor 76 that detects the temperature THW of coolant of the engine 2. Also, the ECU 70 reads signals from an engine speed sensor 80 that detects the rotation speed NE of a crankshaft 78, a cylinder distinguishing sensor 82 that distinguishes cylinders by detecting the rotation phase of the crankshaft 78 or the rotation phase of the intake cams, and a vehicle speed sensor 84 that detects the speed SPD of the vehicle.

Based on the operation state of the engine 2 obtained from these signals, the ECU 70 controls the amount and the timing of fuel injection by the fuel injection valve 58. The fuel injection amount control includes "fuel cutoff" control for suspending fuel injection when, for example, the vehicle is decelerating. Further, the ECU 70 controls the opening degree of the EGR valve 56, the throttle opening degree with the motor 22*b*, and the displacement of the fuel pump 62. Also, the ECU 70 executes catalyst control, such as PM elimination control, sulfur release control and NOx reduction control, and other controls by controlling the opening degree of the fuel adding valve 68.

The ECU 70 selects one of a normal combustion mode and a low temperature combustion mode according to the operating condition. The low temperature combustion mode refers to a combustion mode in which an EGR opening degree map for the low temperature combustion mode is used for recirculating a large amount of exhaust gas (increasing the amount of EGR) to slow down the increase of the combustion temperature, thereby simultaneously reducing NOx and smoke. In the low temperature combustion mode is executed in a low load, low-to-middle rotation speed region, and air-fuel ration feedback control is performed by adjusting the throttle opening degree TA based on the air-fuel ratio AF detected by the air-fuel ratio sensor 48. The other combustion mode is the normal combustion mode, in which a normal EGR control (including a case where no EGR is executed) is performed using an EGR opening degree map for the normal combustion mode.

The ECU 70 performs four catalyst control modes, which are modes for controlling the catalysts. The catalyst control modes include a PM elimination control mode, a sulfur release control mode, a NOx reduction control mode, and a normal control mode.

In the PM elimination control mode, particulate matter deposited on the filter 38*a* in the second catalytic converter 38 is heated and burned. The particulate matter is then converted into $CO_2$ and $H_2O$ and discharged. In this mode, fuel is added to exhaust gas to generate heat by oxidizing fuel in the exhaust gas or the catalysts so that the catalyst bed temperature is increased, for example, to 600 to 700° C. Also, particulate matter around the catalysts is burned. The manner in which this mode is executed will be discussed below.

In the sulfur release control mode, if the NOx storage reduction catalyst 36*a* and the filter 38*a* are poisoned with sulfur and the NOx storage capacity is lowered, sulfur components are released from the catalyst 36*a* and the filter 38*a* so that the catalyst 36*a* and the filter 38*a* are restored from the sulfur poisoning. In this mode, sulfur temperature increase control is performed in which addition of fuel from the fuel adding valve 68 is repeated so that the catalyst bed temperature is increased (for example, to 650° C.). Further, an air-fuel ratio lowering control is performed in which the catalyst bed temperature is maintained high by intermittently adding fuel to exhaust gas by the fuel adding valve, and the air-fuel ratio is changed to the stoichiometric air-fuel ratio or a value slightly lower than the stoichiometric air-fuel ratio. In this embodiment, the air-fuel ratio is richened to be a value slightly less than the stoichiometric air-fuel ratio. The air-fuel ration lowering control is considered to be a type of heating control since fuel addition is executed for maintaining the catalyst bed temperature high. As in the other modes, an after injection is performed by the fuel injection valve 58 in this mode in some cases. The after injection refers to fuel injection to the combustion chambers 4 during the expansion stroke and the exhaust stroke.

In the NOx reduction control mode, NOx stored in the NOx storage reduction catalyst 36*a* and the filter 38*a* is reduced to $N_2$, $CO_2$, and $H_2O$ and emitted. In this mode, addition of fuel from the fuel adding valve 68 is intermittently performed at a relatively long interval so that the catalyst bed temperature becomes relatively low (for example, to a temperature in a range from 250° C. to 500° C.). Accordingly, the air-fuel ratio is lowered to or below the stoichiometric air-fuel ratio.

A state where none of the PM elimination control mode, the sulfur release control mode, and the NOx reduction control mode is being executed corresponds to the normal control mode, in which addition of fuel from the fuel adding valve 68 and the after injection by the fuel injection valve 58 are not performed.

Next, processes related to the PM elimination control mode among the processes executed by the ECU 70 will be described.

If a large amount of fuel is added to exhaust gas at a time to burn particulate matter accumulated in the exhaust purification catalysts, the temperature of the catalysts is suddenly increased, which causes thermal degradation of the catalysts. On the other hand, although a reduced amount of added fuel prevents thermal degradation of the catalysts, particulate matter accumulated in the catalysts will remain unburned.

Figure 2:
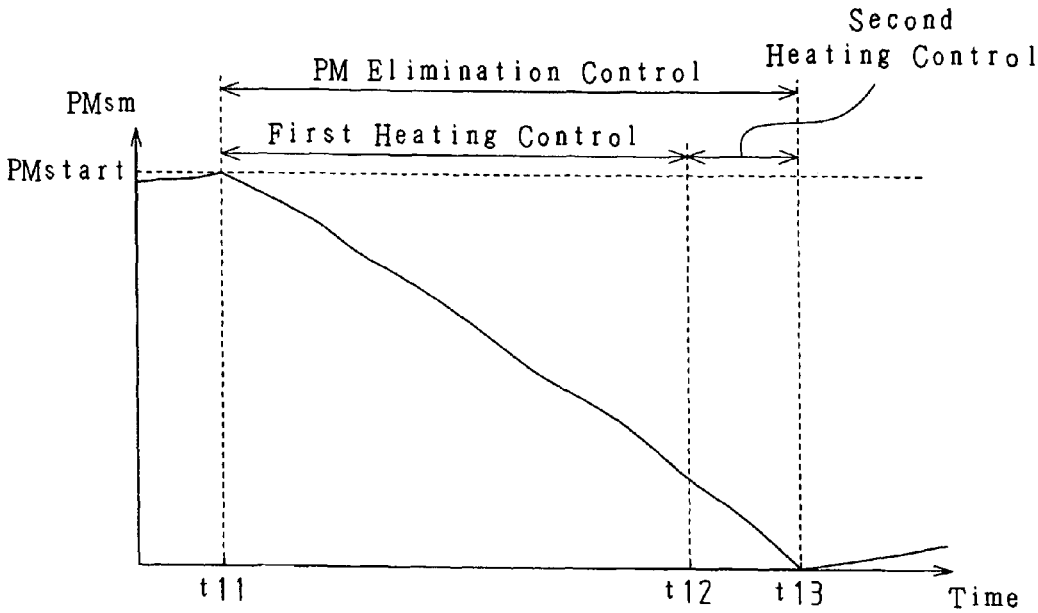
FIG. 2 is a timing chart showing an example of processes related to a PM elimination control mode of the first embodiment.

Therefore, as shown in the timing chart of FIG. 2, first heating control is performed in the PM elimination control mode. In the first heating control, a relatively small amount of fuel is added to exhaust gas in a period from t11 to t12, thereby minimizing increase of the temperature, while reducing the total amount of particulate matter accumulated in the NOx storage reduction catalyst 36*a* and the filter 38*a*. Thereafter, second heating control is performed in which the amount of fuel added to exhaust gas is more than that in the first heating control in a period from t12 to t13. This completely burns particulate matter accumulated in the NOx storage reduction catalyst 36*a*. In this mode also, fuel is added to exhaust gas by addition from the fuel adding valve 68 or the after injection by the fuel injection valve 58.

The PM elimination control is started on the condition that the amount of particulate matter accumulated in the NOx storage reduction catalyst 36*a* (estimated accumulated amount PMsm), which is computed based on the engine operation state, reaches a reference value PMstart (time t11), and is completed when the second heating control is ended (time t13). In the first heating control, fuel is repeatedly added to exhaust gas at an air-fuel ratio higher than the stoichiometric air-fuel ratio, so that the catalyst bed temperature is increased. In the second heating control, the intermittent addition of fuel permits a process to be repeatedly executed in which the air-fuel ratio is set to the stoichiometric air-fuel ratio or an air-fuel ratio slightly less than the stoichiometric air-fuel ratio with periods of no fuel addition between the executions. In this embodiment, the air-fuel ratio is richened to be a value slightly less than the stoichiometric air-fuel ratio.

When the vehicle is driving downhill, the engine load is reduced and the exhaust temperature is lowered accordingly. Also, the relative wind significantly decreases the catalyst bed temperature. It is therefore highly likely that the exhaust purification catalysts will be deactivated.

Figure 3:
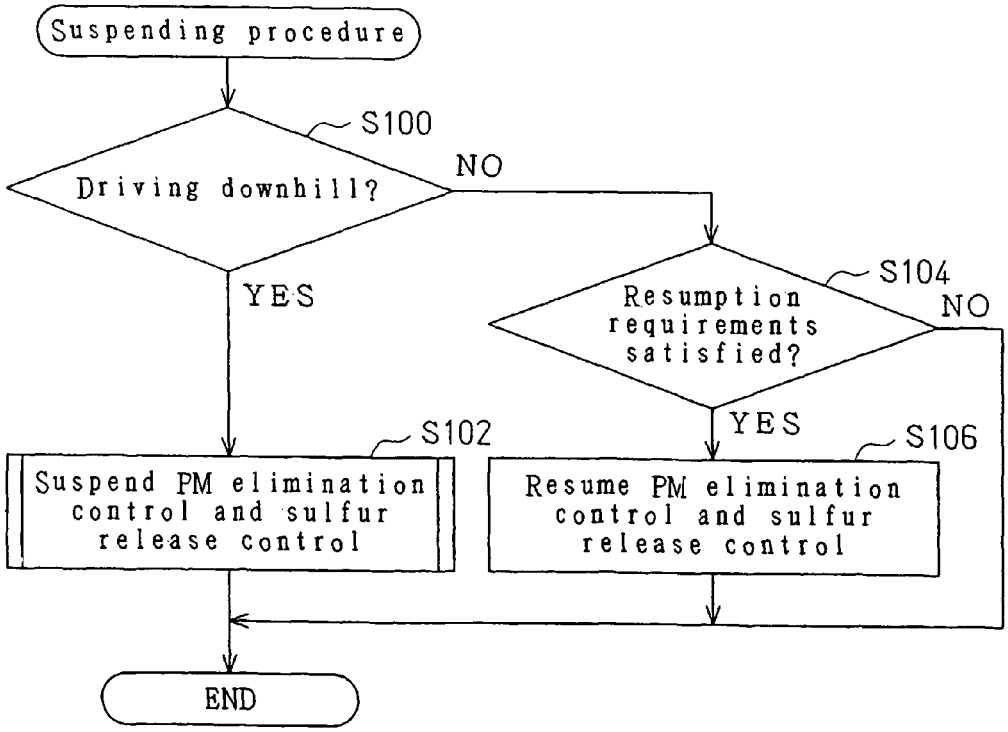
FIG. 3 is a flowchart showing a suspending process of the first embodiment.

With this being the case, the following process is executed in this embodiment when the ECU 70 determines that the vehicle is driving downhill (positive outcome at step S100) as shown in the flowchart of FIG. 3. That is, if the processes related to the PM elimination control (the first and second heating control) or the processes related to the sulfur release control (sulfur temperature increase control and the air-fuel ratio lowering control) are being executed, the processes are suspended at step S102. If the processes are requested to be started, the request is canceled at step S102.

Also, when the processes are suspended, if the ECU 70 determines that the vehicle is not driving downhill (negative outcome at step S100), the processes are resumed (step S106) on the condition that resumption requirements are satisfied (positive outcome at step S104). The resumption requirements include that the exhaust purification catalysts are determined not to be deactivated. For example, the exhaust purification catalysts are determined not to be deactivated when the catalyst bed temperature is sufficient for burning fuel collected on the exhaust purification catalysts, and when the engine operation state is likely to increase to the sufficient temperature, for example, after the engine has been operated for a predetermined period at a high load.

The series of processes shown in the flowchart of FIG. 3 is executed by the ECU 70 at predetermined intervals. The ECU 70 determines whether vehicle is driving downhill or not at step 100 based on whether a downhill flag, which will be discussed below, is ON or OFF.

Figure 4:
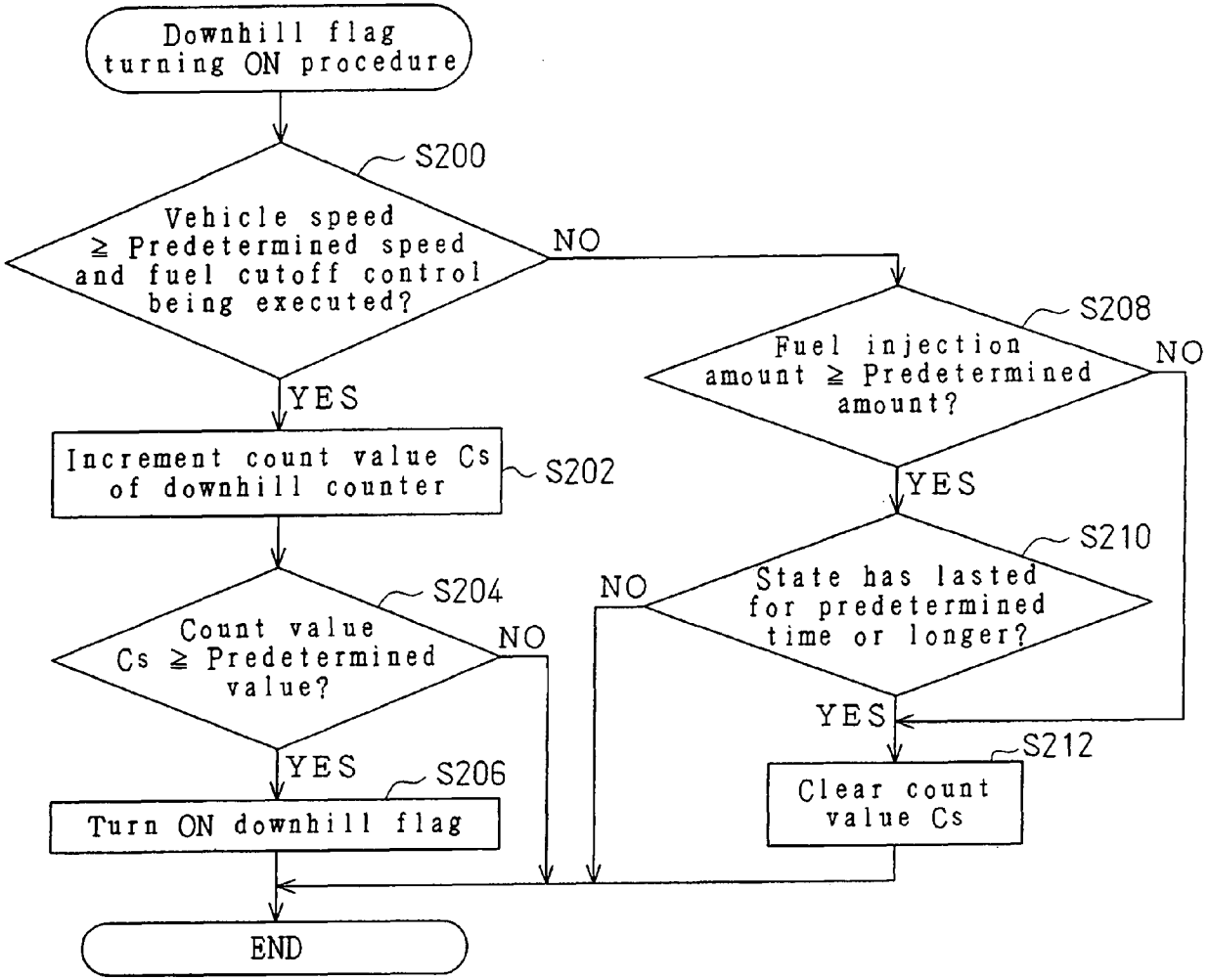
FIG. 4 is a flowchart showing a process for turning on a downhill flag of the first embodiment.

Hereinafter, processes related to the downhill flag will be described. The flowchart of FIG. 4 shows a procedure for turning on the downhill flag. The series of processes shown in the flowchart of FIG. 4 is executed by the ECU 70 at predetermined intervals.

First, whether the following requirements are both satisfied is determined at step S200.

(1) The vehicle speed SPD is equal to or more than a predetermined speed.

(2) The fuel injection amount is zero, or the fuel cutoff control is being executed.

If these requirements are both satisfied (positive outcome at step S200), the vehicle is determined to be driving downhill, and a count value Cs of a downhill counter is incremented at step S202. When the procedure is repeatedly executed and the count value Cs reaches a predetermined value (positive outcome at step S204), the downhill flag is turned on at step S206.

The count value Cs is cleared at step S212 when the above listed requirements are not satisfied (negative outcome at step S200). However, even if the requirements are not satisfied, the count value Cs is not cleared when the fuel injection amount is equal to or more than a predetermined amount (positive outcome at step S208), and the state of the requirements being not satisfied has lasted for a period that is less than a predetermined time (negative outcome at step S210). Even if the vehicle is driving downhill, fuel injection is temporally executed due to gear shift. In such a case, the count value Cs is maintained without being cleared.

Figure 5:
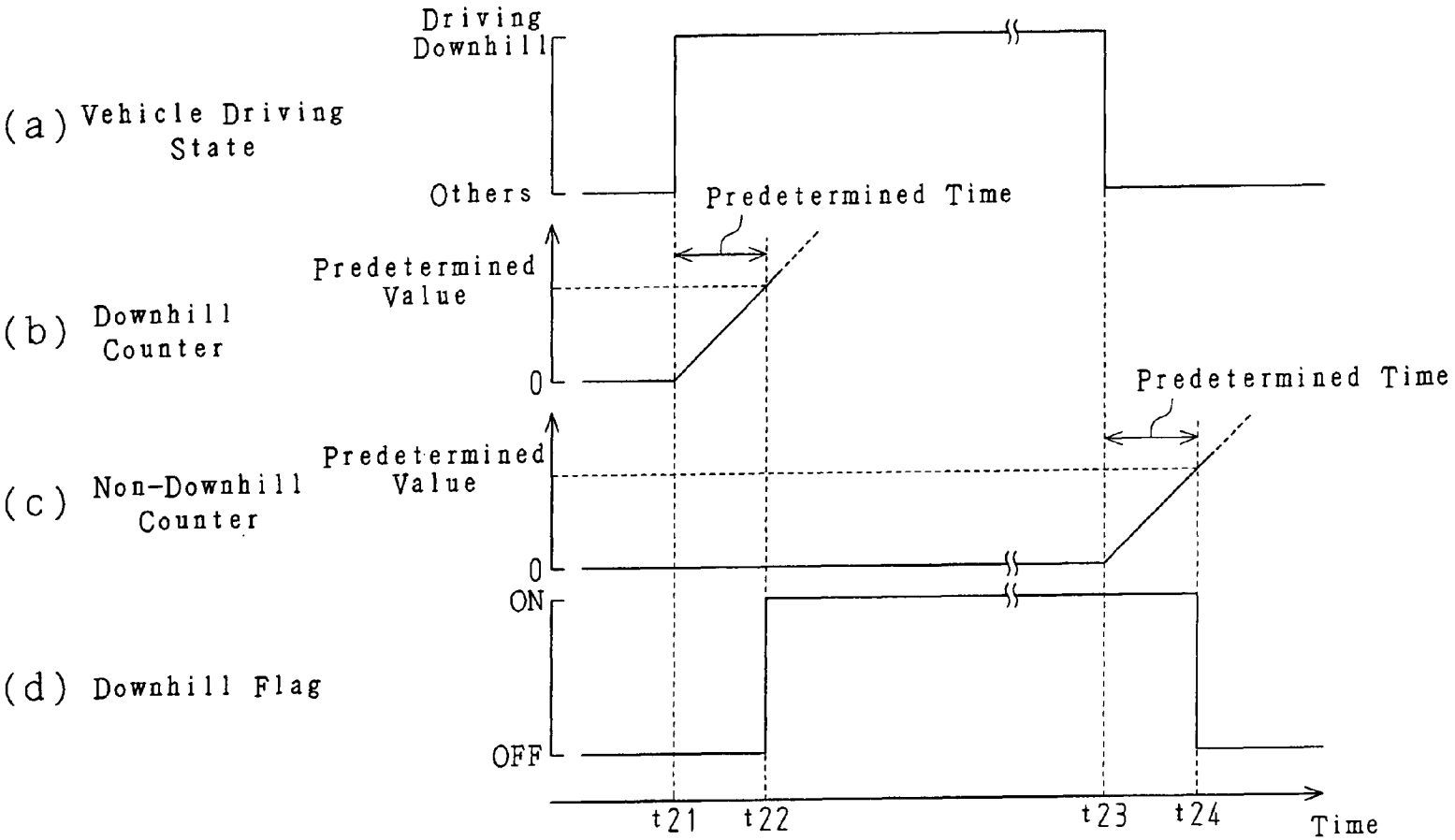
FIG. 5 is a timing chart including sections (a) to (d), which show an example of a control of the downhill flag of the first embodiment.

As shown in the timing chart of FIG. 5, when the vehicle starts driving downhill at time t21, the duration of driving downhill starts being measured with the downhill counter. When the measured time reaches the predetermined time at time t22, the downhill flag is turned on. Then, when the ECU 70 determines that the vehicle is driving downhill based on the fact that the downhill flag is ON at step S100 of FIG. 3, the processes related to the PM elimination control and the processes related to the sulfur release control are suspended as described above.

Figure 6:
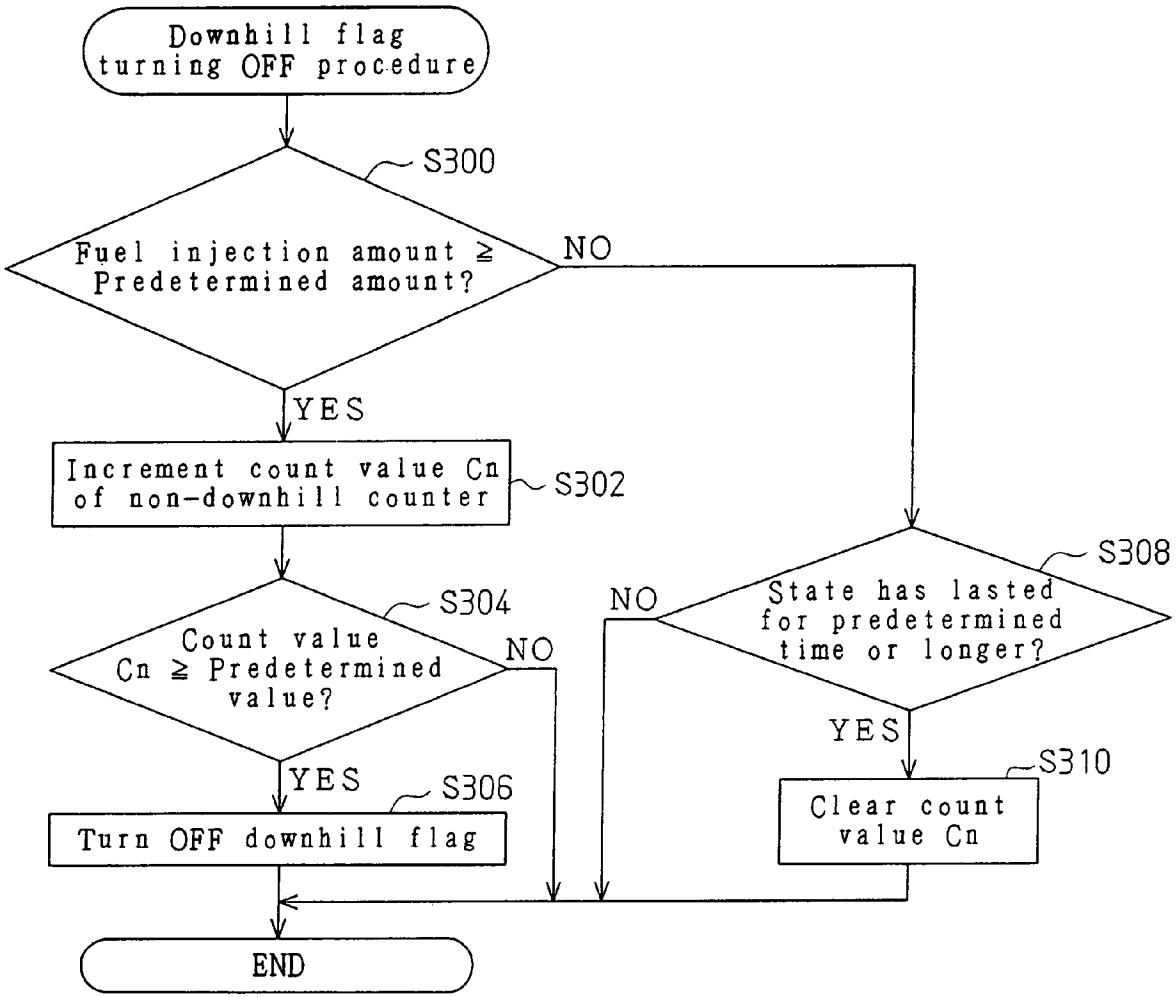
FIG. 6 is a flowchart showing a process for turning off a downhill flag of the first embodiment.

The flowchart of FIG. 6 shows procedure for turning off the downhill flag. The series of processes shown in the flowchart of FIG. 6 is executed by the ECU 70 at predetermined intervals.

First, whether the fuel injection amount is no less than a predetermined amount is determined at step S300. If the fuel injection amount is no less than the predetermined amount (positive outcome at step S300), the vehicle is determined not to be driving downhill, and a non-downhill count value Cn is incremented at step S302. When the procedure is repeatedly executed and the count value Cn reaches a predetermined value (positive outcome at step S304), the downhill flag is turned off at step S306.

The count value Cn is cleared at step S310 when the fuel injection amount is maintained below the predetermined amount (negative outcome at step S300) and this state lasts for a predetermined time or longer (positive outcome at step S308). That is, even if the fuel injection amount is less than the predetermined amount, the count value Cn is not cleared unless the duration is less than the predetermined time (negative outcome at step S308). Even if the vehicle is not driving downhill, the fuel cutoff control can be executed due to operation of the brake or the fuel injection amount can be significantly reduced. In such a case, the count value Cn is maintained without being cleared.

As shown in FIG. 5, when the vehicle stops driving downhill at time t23, the duration of non-downhill driving starts being measured with a non-downhill counter. When the measured time reaches a predetermined time at time t24, the downhill flag is turned OFF. Then, when the ECU 70 determines that the vehicle is not driving downhill based on the fact that the downhill flag is OFF at step S100 of FIG. 3, the suspended processes are resumed at step S106 on the condition that the above listed resumption requirements are satisfied (positive outcome at step S104).

The above described embodiment has the following advantages.

(1) The ECU 70 determines whether the vehicle is driving downhill. When the vehicle is determined to be driving downhill, the processes related to the PM elimination control and the processes related to the sulfur release control are suspended. Accordingly, when the vehicle is driving downhill, the processes are suspended. In other words, the processes are suspended when the engine load is reduced and the exhaust temperature is lowered accordingly, and the relative wind significantly decreases the catalyst bed temperature and it is therefore highly likely that the exhaust purification catalysts will be deactivated. Thus, under circumstances where oxidation of fuel is insufficient, fuel is not supplied to the NOx storage reduction catalyst 36*a* and the filter 38*a*, and adverse influences caused by fuel supply are reliably avoided.

It is also possible to directly detect the catalyst bed temperature and determine deactivation of the exhaust purification catalysts based on the catalyst bed temperature. However, in such a configuration, even if the fuel supply from the fuel adding valve 68 is suspended after a drop of the catalyst bed temperature is detected, the fuel that has been injected until then will continue to be supplied to the NOx storage reduction catalyst 36*a* and the filter 38*a* for a certain period of time. In contrast to this, a drop of the exhaust temperature and even deactivation of the exhaust purification catalysts due to the temperature drop are predicted based on the driving state of the vehicle in this embodiment. Thus, disadvantages caused by adding fuel to the NOx storage reduction catalyst 36*a* and the filter 38*a* when the catalyst 36*a* and the filter 38*a* are deactivated are avoided.

(2) The ECU 70 determines that the vehicle is driving downhill when the fuel cutoff control is being executed. Therefore, when the fuel cutoff control is being executed, the disadvantages are reliably avoided. In other words, the disadvantages are avoided when there is no engine combustion heat and the catalyst bed temperature abruptly drops accordingly, and there is a possibility that the catalysts are deactivated in a short time compared to the state where the engine is idling.

(3) The processes related to the PM elimination control and the processes related to the sulfur release control are suspended only when a predetermined period has elapsed since when the vehicle is determined to be driving downhill. In other words, the processes are suspended only when there is a high possibility that the exhaust purification catalysts are deactivated. Therefore, sufficient period for the processes are obtained in most of the cases, while avoiding the disadvantages. Further, even if the fuel injection amount during non-downhill driving temporarily becomes equal to that of downhill driving because of shifting of gears or operation of the brake, the ECU 70 is prevented from erroneously determining that the vehicle is driving downhill. That is, the determination accuracy of the ECU 70 is improved.

(4) When the processes related to the PM elimination control and the processes related to the sulfur release control are suspended based on the determination of the ECU 70 that the vehicle is driving downhill, the processes are resumed if the ECU 70 determines that the vehicle is determined to not to be driving downhill. This ensures that the processes are executed when the vehicle stops driving downhill.

(5) Also, the processes related to the PM elimination control and the processes related to the sulfur release control are resumed only when a predetermined period has elapsed since when the vehicle is determined not to be driving downhill. Thus, the processes are resumed when the catalyst bed temperature has been increased after the vehicle stops driving downhill. The processes are therefore resumed under favorable conditions.

Hereinafter, an exhaust purifying apparatus for an internal combustion engine on a vehicle according to a second embodiment of the present invention will be described.

The second embodiment is different from the first embodiment in the manner by which the processes related to the PM elimination control and the process related to the sulfur release control are suspended.

Figure 7:
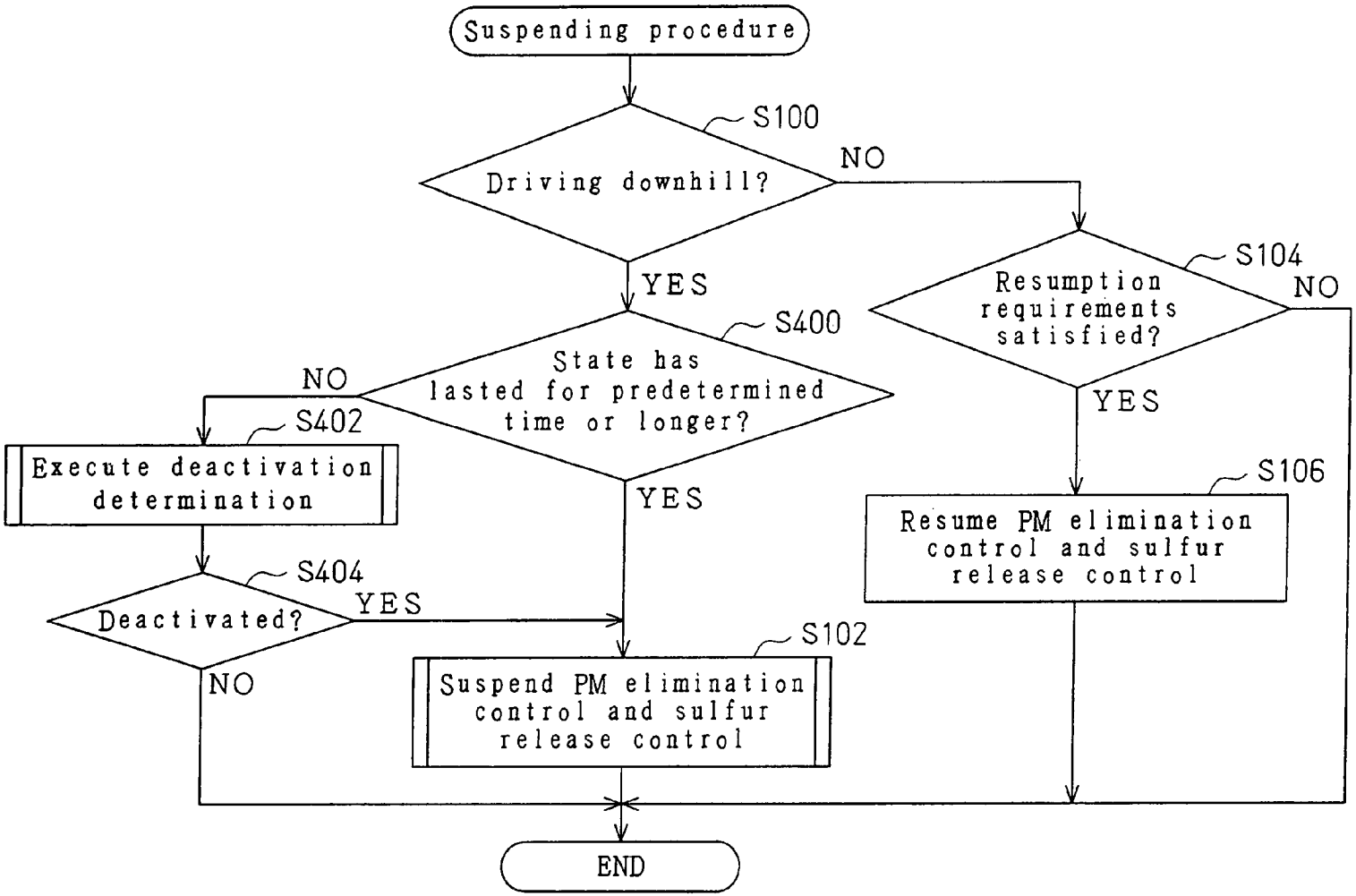
FIG. 7 is a flowchart showing a suspending process according to a second embodiment of the present invention.

The flowchart of FIG. 7 shows a procedure for suspending the processes. The series of processes shown in the flowchart of FIG. 7 is executed by the ECU 70 at predetermined intervals. Since steps S100 to S106 of FIG. 7 are the same as steps S100 to S106 in the flowchart according to the first embodiment shown in FIG. 3, the same numerals are used for the steps of FIG. 7 and the explanations are omitted.

In the flowchart of FIG. 7, the ECU 70 first determines at step S100 whether the vehicle is driving downhill. When the ECU 70 determines that the vehicle is driving downhill (positive outcome at step S100), whether this determination has continued for a predetermined period is determined at step S400. Specifically, whether the downhill flag has been on for the predetermined period is determined.

If the determination that the vehicle is driving downhill has not continued for the predetermined period (negative outcome at step S400), whether the exhaust purification catalysts are deactivated is determined (deactivation determination) at step S402.

If the exhaust purification catalysts are not determined to be deactivated (negative outcome at step S404), the processes related to the PM elimination control and the process related to the sulfur release control are not suspended but continued. On the other hand, if the exhaust purification catalysts are determined to be deactivated (positive outcome at step S404), the processes are suspended at step S102 in the manner described above.

Thereafter, when the procedure is repeatedly executed and the duration of the on state of the downhill flag reaches the predetermined period (positive outcome at step S400), the processes are suspended at step S102 without determining the deactivation.

Hereinafter, a specific procedure of the deactivation determination will be described with reference to the flowchart of FIG. 8. The series of processes shown in the flowchart of FIG. 8 is executed by the ECU 70 at predetermined intervals.

First, whether a exhaust temperature Ti detected by the first exhaust temperature sensor 44 is equal to or more than a predetermined value is determined at step S500. Specifically, the processes related to the PM elimination control and the processes related to the sulfur release control are determined to be currently executed if the exhaust temperature Ti is equal to or more than the predetermined value.

If the processes are not currently executed (negative outcome at step S500), the exhaust purifying catalysts are not determined to be deactivated.

On the other hand, if the processes are currently executed (positive outcome at step S500), it is determined at step S502 whether the difference (Ti−Tb) between the exhaust temperature Ti and a reference temperature Tb computed based on the engine operation state has been less than a predetermined value γ for a predetermined period.

The temperature Ti is used as an indicator of the bed temperature of the NOx storage reduction catalyst 36*a*. The catalyst bed temperature in a state where fuel is not being added to exhaust gas, or in a state where no procedure for increasing the catalyst bed temperature is being executed, is used as the reference temperature Tb. Specifically, the reference temperature Tb is successively computed based on the engine operation state, or the engine rotation speed NE and the fuel injection amount, which are highly correlated with the exhaust temperature.

When the temperature difference has been less than the predetermined value γ for the predetermined period (positive outcome at step S502), it is determined that, even if fuel is being added to exhaust gas to increase the catalyst bed temperature, the exhaust temperature Ti is low as in a case where little fuel is burned. That is, it is determined that the bed temperature of the NOx storage reduction catalyst 36*a* is lowered. In this case, the exhaust purification catalysts are determined to be deactivated at step S504.

On the other hand, when the temperature difference is equal to or more than the predetermined value γ or when the temperature difference has been less than the predetermined value γ for a period shorter than the predetermined period (negative outcome at step S502), the exhaust purification catalysts are not determined to be deactivated.

In this embodiment, when the duration of the ON state of the downhill flag is short (from time t31 to time t32 shown in the timing chart of FIG. 9), that is, when the vehicle has driven downhill for a short time and the exhaust purification catalysts are not likely to be deactivated, the deactivation determination described above is executed. If the exhaust purification catalysts are not determined to be deactivated, the processes related to the PM elimination control and the processes related to the sulfur release control are continued. The time for executing the processes is maximized.

On the other hand, if the ECU 70 determines that the exhaust purification catalysts are deactivated during the execution of the processes (time t32), or when the duration of the downhill driving exceeds a predetermined time and it is highly likely that the exhaust purification catalysts are deactivated (time t33), the processes, which are being executed, are suspended. Therefore, above described disadvantages are avoided.

The illustrated embodiments may be modified as follows.

In the second embodiment, the processes related to determination of deactivation may be changed. For example, while the processes related to the PM elimination control and the processes related to the sulfur release control are executed, the exhaust purification catalysts may be determined to be deactivated if the difference (To−Ti) between the exhaust temperature Ti detected by the first exhaust temperature sensor 44 and an exhaust temperature To detected by the second exhaust temperature sensor 46 is greater than a predetermined value. In this case, a state is detected in which the bed temperature of the NOx storage reduction catalyst 36*a* is low and the bed temperature of the catalyst on the filter 38*a* is high, in other words, fuel added by the fuel adding valve 68 is not burned in the NOx storage reduction catalyst 36*a* but is burned in the filter 38*a*. Accordingly, the NOx storage reduction catalyst 36*a* is determined to be deactivated.

In the illustrated embodiment, the requirements for determining that the vehicle is driving downhill include that the fuel cutoff control is being executed. Instead, the vehicle may be determined to be driving downhill when the fuel injection amount of the engine is equal to or less than a predetermined amount. Alternatively, a tilt sensor may be mounted on the vehicle, and the vehicle may be determined to be driving downhill when the tilt sensor detects that the front portion of the vehicle is lower than the rear portion.

In the illustrated embodiments, the processes related to the PM elimination control and the processes related to the sulfur release control are suspended only when a predetermined period has elapsed since when the vehicle is determined to be driving downhill. The predetermined period may be varied based on the engine load and the vehicle speed SPD. Specifically, it may be configured that the lower the engine load or the higher the vehicle speed SPD, the shorter the predetermined period is set. Even if the vehicle is driving downhill, the rate of decrease of the catalyst bed temperature varies depending on the engine load (exhaust temperature) and the vehicle speed SPD (relative wind). However, according to the configuration of this modification, the predetermined period is set in accordance with the rate of decrease of the catalyst bed temperature. Therefore, the above described disadvantages are reliably avoided.

The processes related to the PM elimination control and the processes related to the sulfur release control may be suspended when the vehicle is determined to be driving downhill.

In the illustrated embodiments, when the ECU 70 determines that the vehicle is not driving downhill, the processes related to the PM elimination control and the processes related to the sulfur release control, which have been suspended based on the determination that the vehicle is driving downhill, may be resumed even if the resumption requirements are not satisfied. This configuration also allows the above described disadvantages to be avoided when the vehicle is driving downhill.

When the vehicle is determined to be driving downhill, one to three processes among the first heating control and the second heating control related to the PM elimination control and the sulfur heating control and the air-fuel ratio lowering control related to the sulfur release control may be selectively suspended. Since a relatively large amount of fuel is added to exhaust gas in the second heating control by the fuel adding valve 68, addition of fuel to the exhaust purification catalysts in the deactivated state makes the disadvantages noticeable. Therefore, to eliminate the disadvantages accompanying the execution of the second heating control, at least the second heating control is preferably suspended when the vehicle is determined to be driving downhill.

Also, when the vehicle is determined not to be driving downhill, one to three processes among the first heating control and the second heating control related to the PM elimination control and the sulfur heating control and the air-fuel ratio lowering control related to the sulfur release control may be selectively resumed. If the second heating control is suspended, particulate matter remains on the upstream end face of the NOx storage reduction catalyst 36*a*. When excessive, the accumulated amount of particulate matter causes clogging of the NOx storage reduction catalyst 36*a*. Also, when the excessive accumulated amount of particulate matter is burned at a time, the catalyst bed temperature is excessively increased. To reliably eliminate particulate matter, at least the second heating control is preferably resumed when the vehicle is determined not to be driving downhill.

Step S106 of FIGS. 3 and 7 may be omitted. That is, it may be configured that the processes related to the PM elimination control and the processes related to the sulfur release control are not resumed even if the vehicle is determined not to be driving downhill.

The exhaust purifying apparatus of the present invention may be applied to any internal combustion engine having a configuration other than that shown in FIG. 1. That is, the present invention may be, in any of the above presented embodiments or forms that are pursuant to the embodiments, applied to any type of exhaust purifying apparatus for an internal combustion engine on a vehicle as long as the apparatus has a regeneration control section that performs heating control to supply fuel to an exhaust purification catalysts to increase the catalyst bed temperature, thereby regenerating the catalysts.

The invention claimed is:

1. An exhaust purifying method for an internal combustion engine on a vehicle, the method comprising:

supplying fuel to an exhaust purification catalyst to increase a bed temperature of the catalyst, thereby regenerating the exhaust purification catalyst, wherein the fuel is supplied to exhaust gas via a fuel adding valve;

determining whether the vehicle is driving downhill; and suspending the supply of fuel to the exhaust purification catalyst when the vehicle is determined to be driving downhill, wherein the supply of fuel to the exhaust purification catalyst is suspended only when the vehicle is continuously determined for a predetermined period to be driving downhill, wherein the determining includes determines that the vehicle is driving downhill when the amount of fuel injected by a fuel injection valve of the engine is equal to or less than a predetermined amount and a vehicle driving speed is equal to or greater than a predetermined driving speed, wherein the supplying fuel includes first heating control, in which the amount of fuel supplied to the exhaust purification catalyst is relatively small, and second heating control, in which the amount of fuel supplied to the exhaust purification catalyst is relatively large, and wherein the suspending the supply of fuel includes suspending at least the second heating control when it is determined that the vehicle is driving downhill.

2. An exhaust purifying apparatus for an internal combustion engine on a vehicle, the apparatus comprising:

a regeneration control section, wherein the regeneration control section controls regeneration of an exhaust purification catalyst through heating control, in which fuel is supplied to the exhaust purification catalyst, thereby increasing a bed temperature of the catalyst; and a determining section that determines whether the vehicle is driving downhill, wherein the regeneration control section suspends the heating control when the determining section determines that the vehicle is driving downhill, wherein the regeneration control section suspends the heating control only when the determining section continuously determines for a predetermined period that the vehicle is driving downhill, and wherein the heating control includes first heating control, in which the amount of fuel supplied to the exhaust purification catalyst is relatively small, and second heating control, in which the amount of fuel supplied to the exhaust purification catalyst is relatively large, wherein the regeneration control section suspends at least the second heating control when the determining section determines that the vehicle is driving downhill.

3. The apparatus according to claim 2, wherein the determining section determines that the vehicle is driving downhill when the amount of fuel injected by a fuel injection valve of the engine is equal to or less than a predetermined amount and a vehicle driving speed is equal to or greater than a predetermined driving speed.

4. The apparatus according to claim 2, wherein the determining section determines that the amount of fuel injected by the fuel injection valve is equal to or less than the predetermined amount when fuel cutoff control, in which fuel injection by the fuel injection valve is suspended, is being executed.

5. The apparatus according to claim 2, wherein, while the heating control is suspended due to determination of the determining section that the vehicle is driving downhill, the regeneration control section resumes the heating control if the determining section determines that the vehicle is not driving downhill.

6. The apparatus according to claim 5, wherein the regeneration control section resumes the heating control only when the determining section continuously determines for a predetermined period that the vehicle is not driving downhill.

* * * * *

UNITED STATES PATENT AND TRADEMARK OFFICE

CERTIFICATE OF CORRECTION

PATENT NO. : 8,079,212 B2
APPLICATION NO. : 10/589205
DATED : December 20, 2011
INVENTOR(S) : Matsuoka Hiroki et al.

It is certified that error appears in the above-identified patent and that said Letters Patent is hereby corrected as shown below:

| Column | Line | |
|---|---|---|
| 12 | 40 | After “includes” change “determines” to --determining--. |

Signed and Sealed this
Twenty-fifth Day of December, 2012

David J. Kappos

David J. Kappos
*Director of the United States Patent and Trademark Office*